US008528980B1

(12) United States Patent
Hsiao

(10) Patent No.: US 8,528,980 B1
(45) Date of Patent: Sep. 10, 2013

(54) SEAT BACK UNIT

(76) Inventor: Fu-Chih Hsiao, Tainan (TW)

( * ) Notice: Subject to any disclaimer, the term of this patent is extended or adjusted under 35 U.S.C. 154(b) by 0 days.

(21) Appl. No.: 13/532,789

(22) Filed: Jun. 26, 2012

(51) Int. Cl.
*A47C 7/02* (2006.01)
*A47C 7/46* (2006.01)

(52) U.S. Cl.
USPC ..... 297/452.18; 297/452.33; 297/284.4

(58) Field of Classification Search
USPC ..... 297/353, 452.18, 452.3, 452.33, 297/284.4, 452.28, 452.63
See application file for complete search history.

(56) References Cited

U.S. PATENT DOCUMENTS 6,616,228 B2 * 9/2003 Heidmann ..... 297/284.4
7,014,269 B2 * 3/2006 Coffield et al. ..... 297/452.56
7,568,765 B2 * 8/2009 Brauning ..... 297/354.1
7,775,601 B2 * 8/2010 Wu ..... 297/452.3
7,896,438 B2 * 3/2011 Whelan et al. ..... 297/284.4
8,272,691 B2 * 9/2012 Hsuan-Chin ..... 297/285

* cited by examiner

*Primary Examiner* — Sarah B McPartlin

(57) ABSTRACT

A seat back unit connected to a seat of a chair comprises a main frame having vertical and horizontal sections. A first hinge portion is disposed on a top end of the vertical section, and a resting seat with an embedded concave portion is fixed to a middle segment of the vertical section. Connection projections are disposed on a junction between the vertical and horizontal sections. A supporting member has one end formed with a second hinge portion, and the other end formed with a crossing portion embedded into the embedded concave portion. A backrest member is composed of vertical and transversal curved sections. The vertical arch section has third and fourth hinge portions corresponding to the first and second hinge portions, respectively. A herringbone-shaped structure composed of the vertical arch section and the transversal curved sections conforms to the profile variation of the human body.

2 Claims, 8 Drawing Sheets

SEAT BACK UNIT

BACKGROUND OF THE INVENTION (1) Field of the Invention

The invention relates to a seat back unit, and more particularly to a seat back unit having a herringbone-shaped structure formed by a vertical arch section of a backrest member and several transversal curved sections, and the herringbone-shaped structure conforms to the profile variation of the human body and provides different supporting forces according to the weights of different parts of the body.

(2) Description of the Prior Art

The people are seated at most of time in the daily life and the working period. Therefore, whether the chair is safe and comfortable has become the primary requirement of the people.

Although the existing chair has the seat back, the seat back has the stiff line profile, cannot satisfy the requirement of the body profile and cannot provide the independent supports for various parts of the body. In addition, the supporting force also cannot be adjusted. When a person is seated for a long time, the body tends to get tired. Because the supporting forces cannot be adjusted, the supporting forces applied to different parts of the body are different. After a long time, some parts of the body may feel uncomfortable, lack of energy, have aches and encounter the chronic back problem.

SUMMARY OF THE INVENTION

The invention is provided to solve the problem encountered in actually using a conventional seat back.

The invention provides a seat back unit, which is to be connected to a seat of a chair and comprises a main frame, a supporting member and a backrest member. The main frame is a L-shaped member having a vertical section and a horizontal section, a top end of the vertical section has a first hinge portion, a resting seat having an embedded concave portion is fixed to a middle segment of the vertical section, and connection projections are disposed on a junction between the vertical section and the horizontal section. The supporting member is a plate member having one end formed with a second hinge portion, and the other end formed with a crossing portion, which is embedded into the embedded concave portion of the resting seat. The backrest member is composed of a vertical arch section and transversal curved sections. The vertical arch section has a third hinge portion and a fourth hinge portion corresponding to the first hinge portion of the main frame and the second hinge portion of the supporting member, respectively.

The vertical arch section and the transversal curved sections of the backrest member are shaped into a herringbone-shaped structure.

The vertical arch section of the backrest member has the resilient force for automatically recovering to the original shape after the deformation caused by the supported weight.

Each transversal curved section of the backrest member is covered with a seat backrest pad made of a foam material. The pivotal connection portion between the first hinge portion of the main frame and the third hinge portion of the backrest member is covered by a headrest pad body in the form of an inverse-U shape. The headrest pad body is made of a foam material.

The seat back unit of the invention has the following advantages.

1. The vertical arch section and the transversal curved sections of the backrest member of the invention are shaped into the herringbone-shaped structure, which conforms to the profile variation of the human body and correspondingly provides different supporting forces according to the weights of different parts of the body. Thus, the loading pressures of various parts of the body have the average distribution, so that the fatigue of the cervical vertebra or vertebra of the seated person is eased, and the requirement of supporting the back of the seated person can be provided.

2. The vertical arch section of the backrest member of the invention has the resilient force for automatically recovering to the original shape after the deformation caused by the supported weight. The supporting member connected between the main frame and the backrest member can provide a stable supporting force when the backrest member is pressed and deformed, so that the backrest member supports the back of the seated person and has the comfortable flexibility and the stable security.

3. The supporting member is slantingly disposed between the backrest member and the main frame of the seat back unit of the invention. On end of the supporting member rests against and is fixed to the resting seat of the main frame and can be rotated relatively to the main frame. The other end of the supporting member is pivotally connected to the backrest member and can be rotated relatively to the backrest member. The supporting member prevents the supporting force of the backrest member from being concentrated at the same place, thereby enhancing the use security and the structural strength of the seat back unit.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

Figure 1:
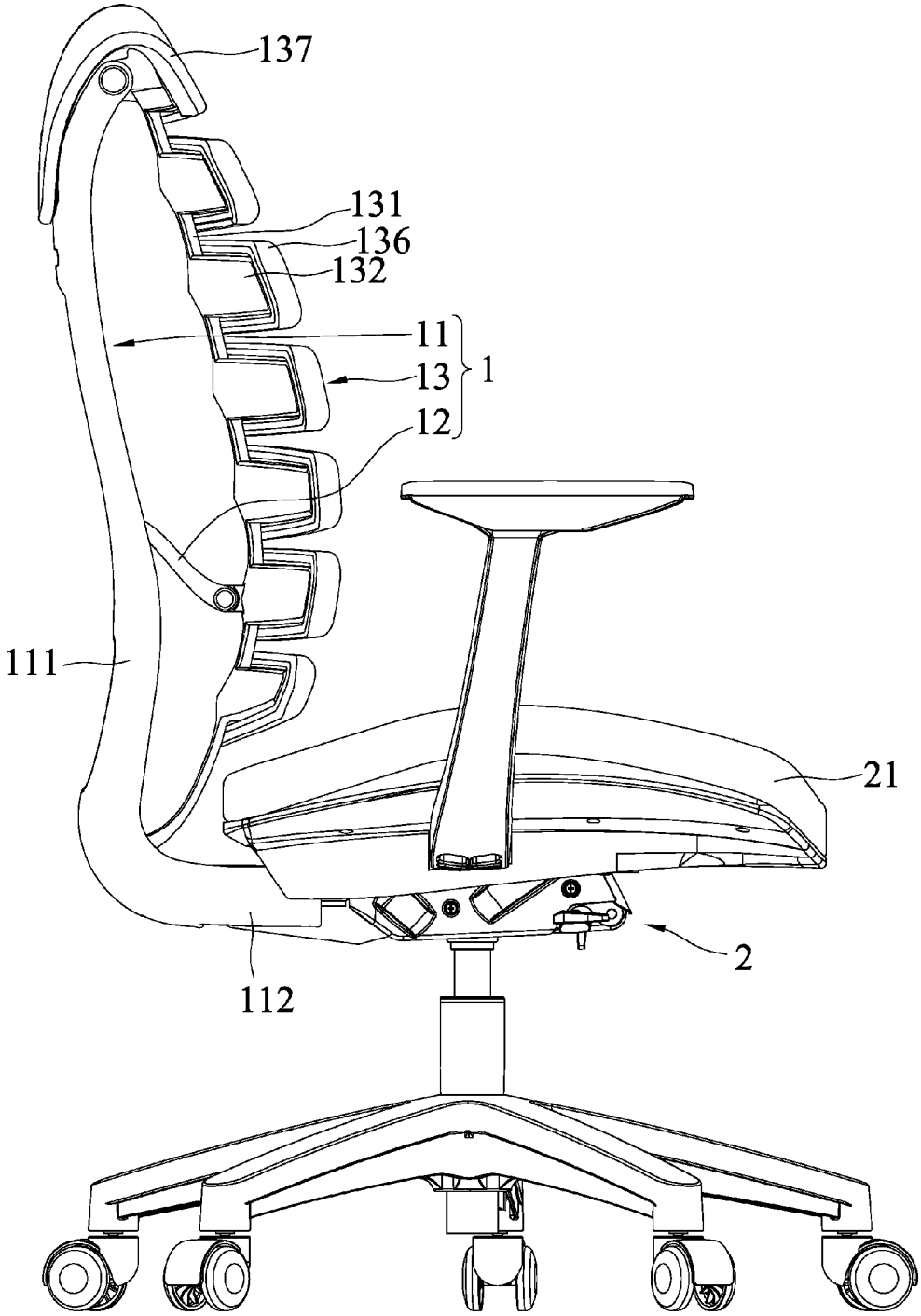
FIG. 1 is a side view showing the invention connected to a chair seat.
Figure 2:
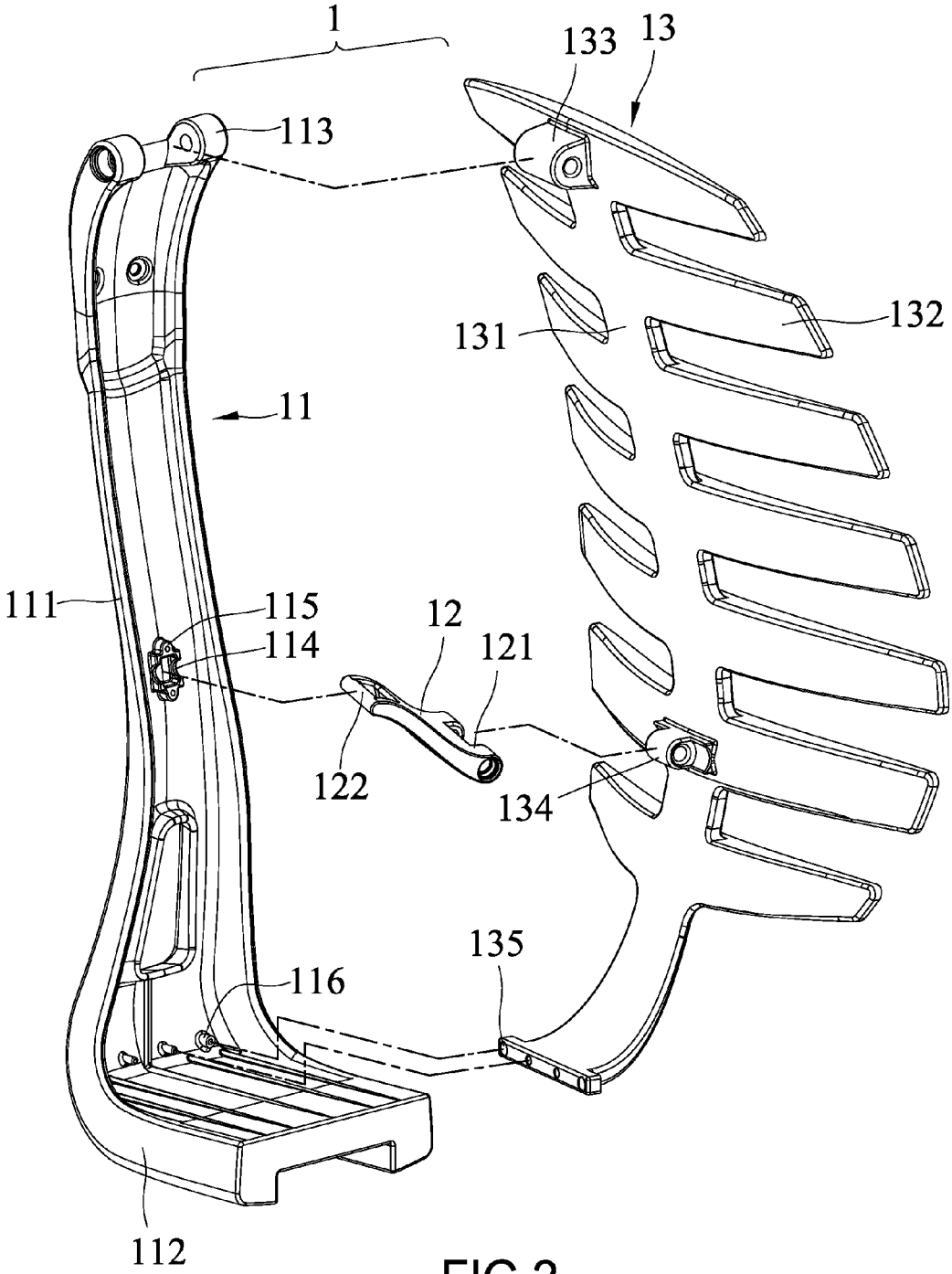
FIG. 2 is an exploded view showing members of the invention.
Figure 3:
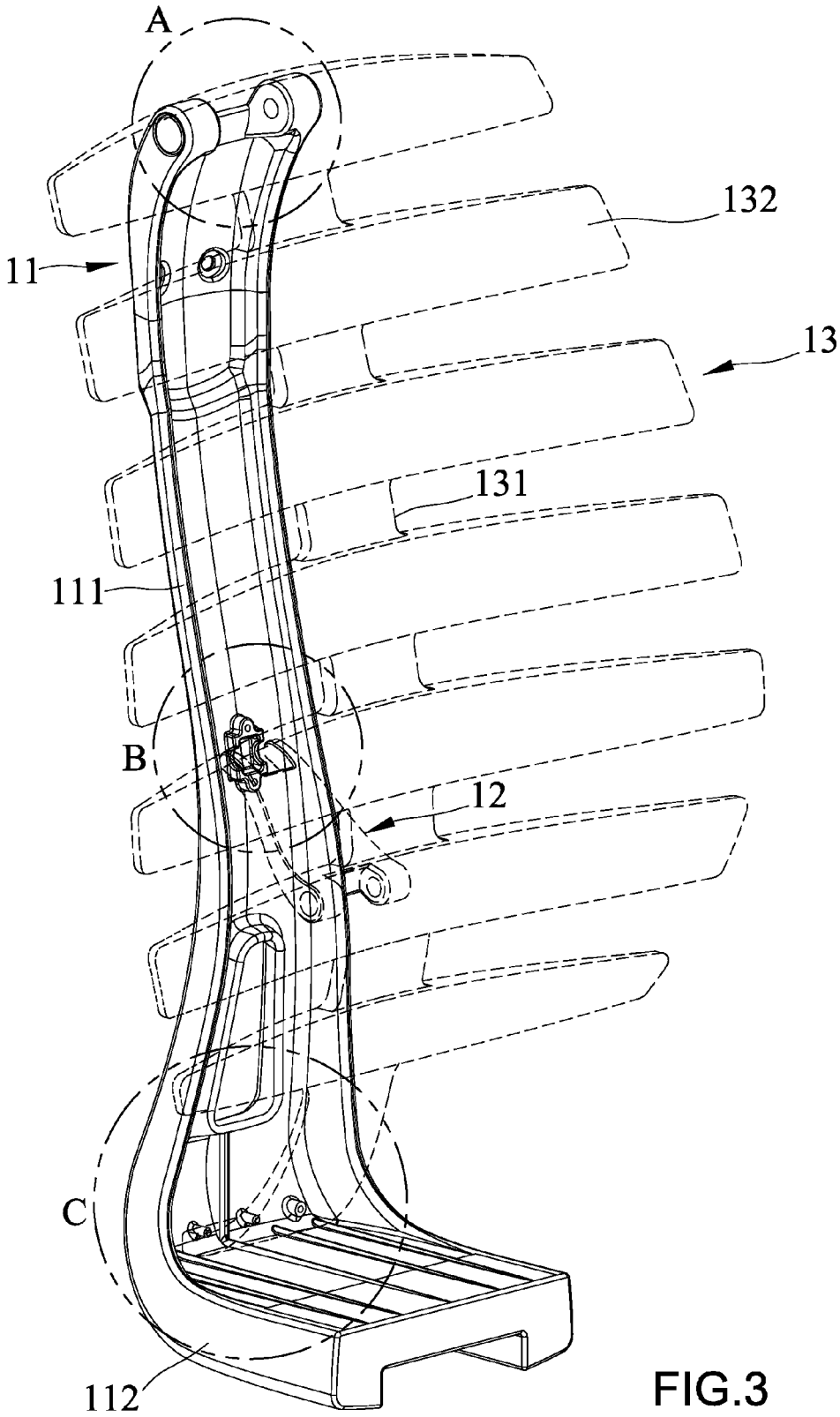
FIG. 3 is a pictorial front view showing the invention.

Referring to FIGS. 1 to 3, a seat back unit 1 of the invention is connected to a seat 21 of a chair 2 (see FIGS. 7 and 8) and comprises a main frame 11, a supporting member 12 and a backrest member 13.

The main frame 11 is a L-shaped member having a vertical section 111 and a horizontal section 112, as shown in FIG. 2. The top end of the vertical section 111 has a first hinge portion 113, a resting seat 115 having an embedded concave portion 114 is fixed to the middle segment of the vertical section 111, and several connection projections 116 are disposed on the junction between the vertical section 111 and the horizontal section 112.

The supporting member 12 is a plate member having one end formed with a second hinge portion 121, and the other end formed with a crossing portion 122, as shown in FIG. 2.

Figure 5:
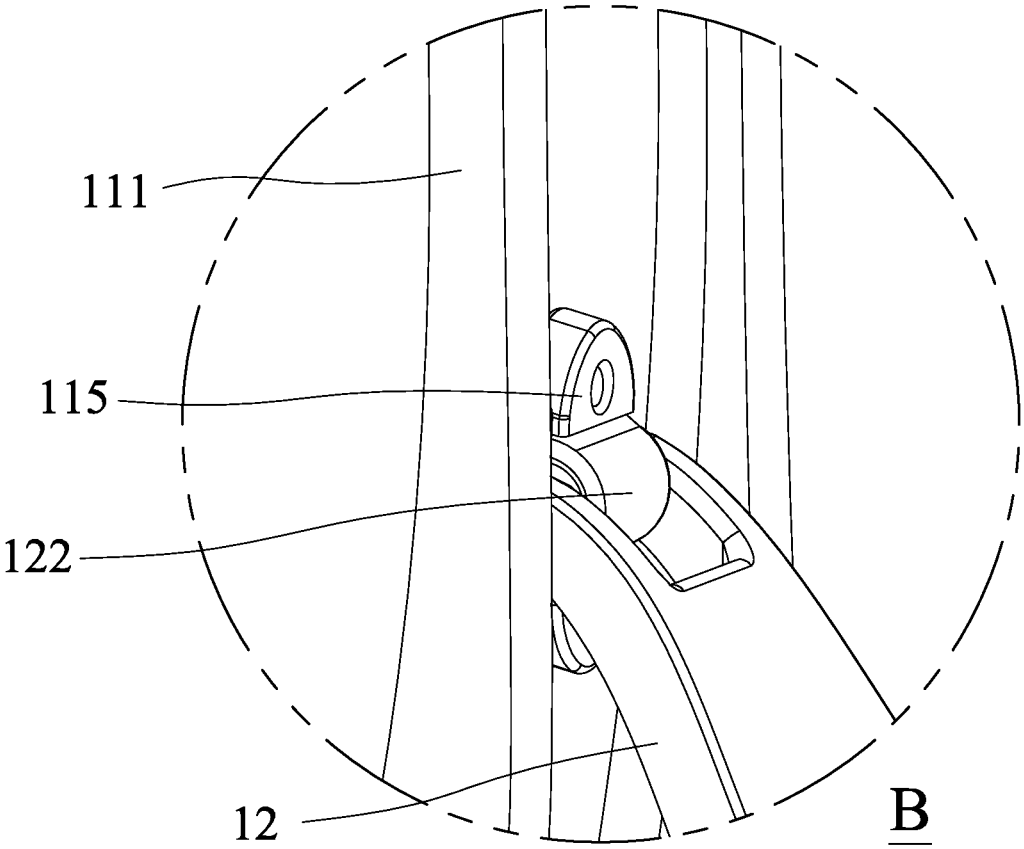
FIG. 5 shows the details of the portion B of the invention.

The crossing portion 122 is embedded into the embedded concave portion 114 of the resting seat 115, as shown in FIG. 5.

Figure 4:
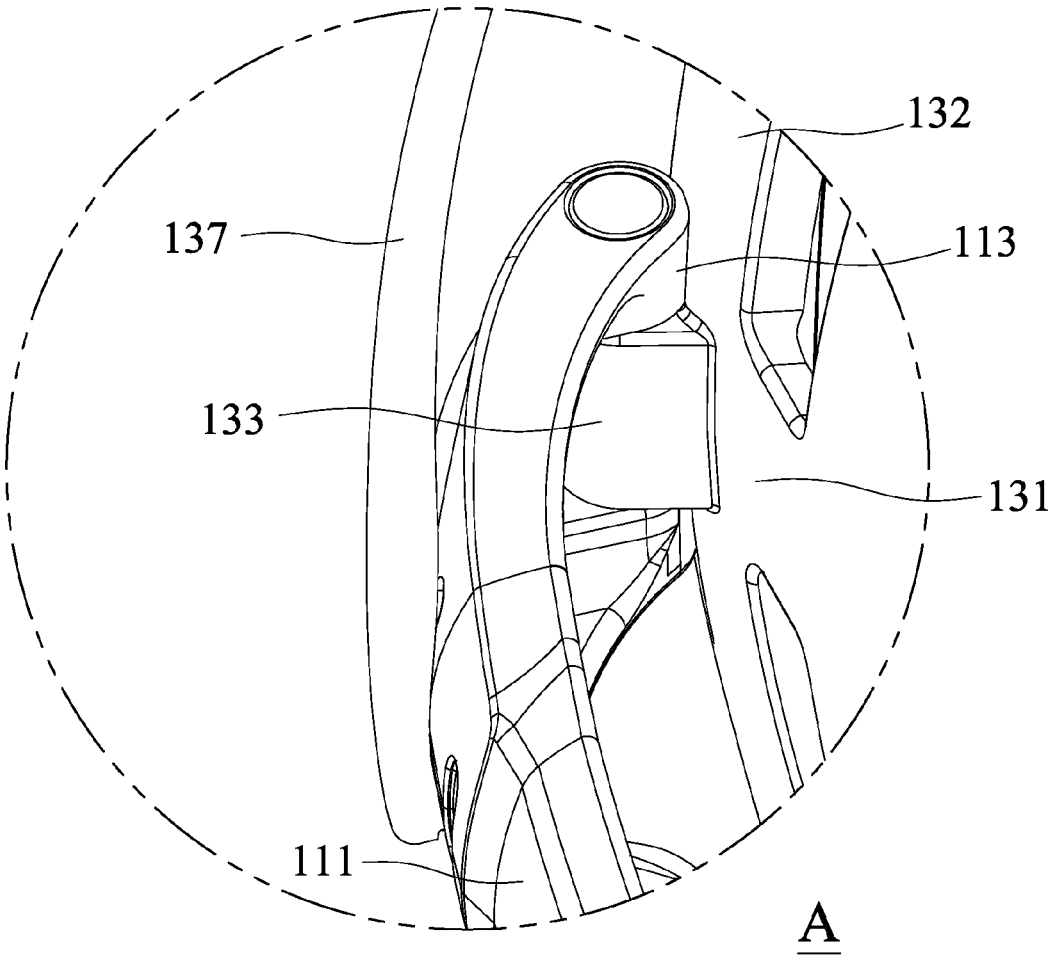
FIG. 4 shows the details of the portion A of the invention.
Figure 6:
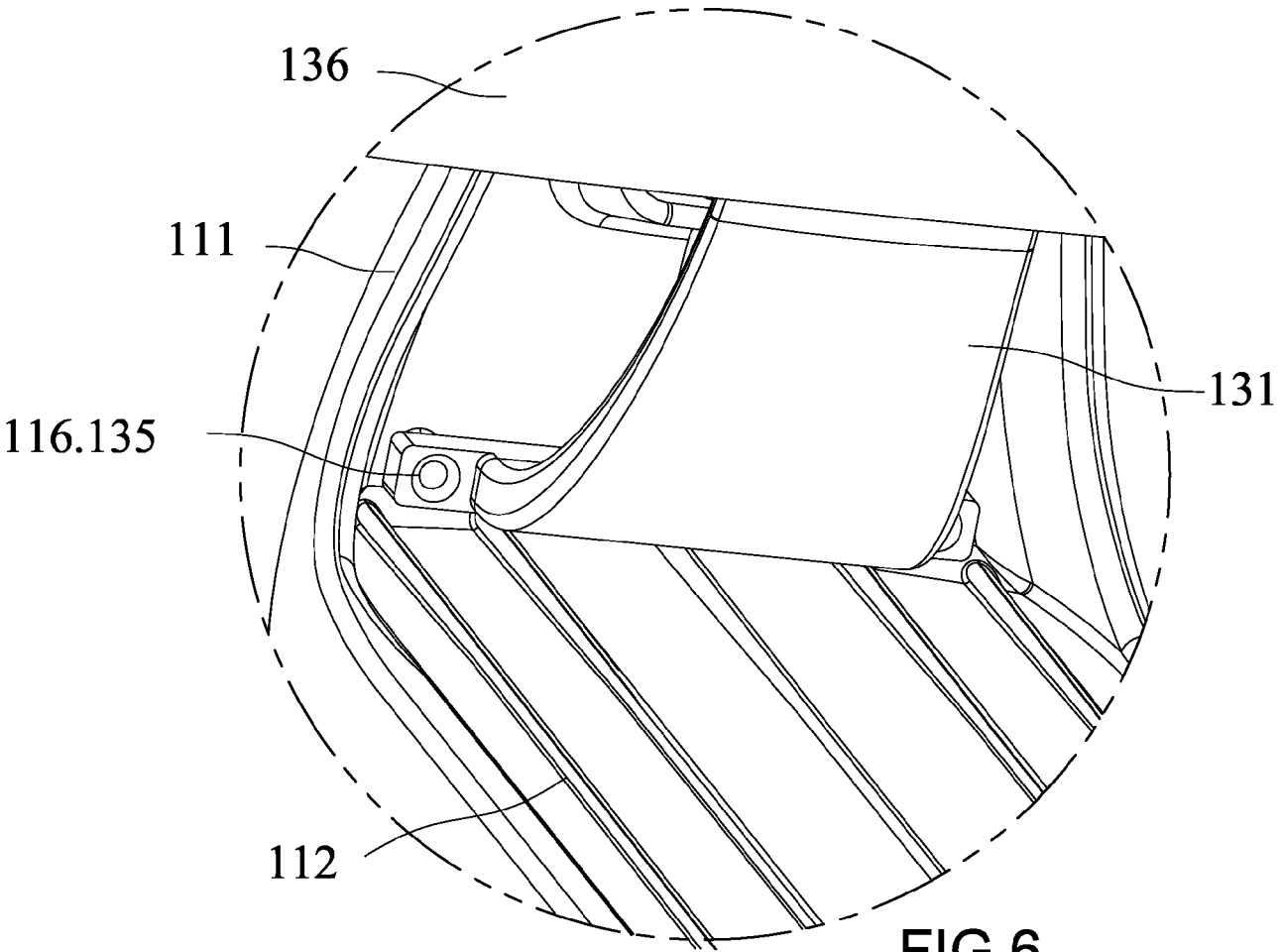
FIG. 6 shows the details of the portion C of the invention.
Figure 7:
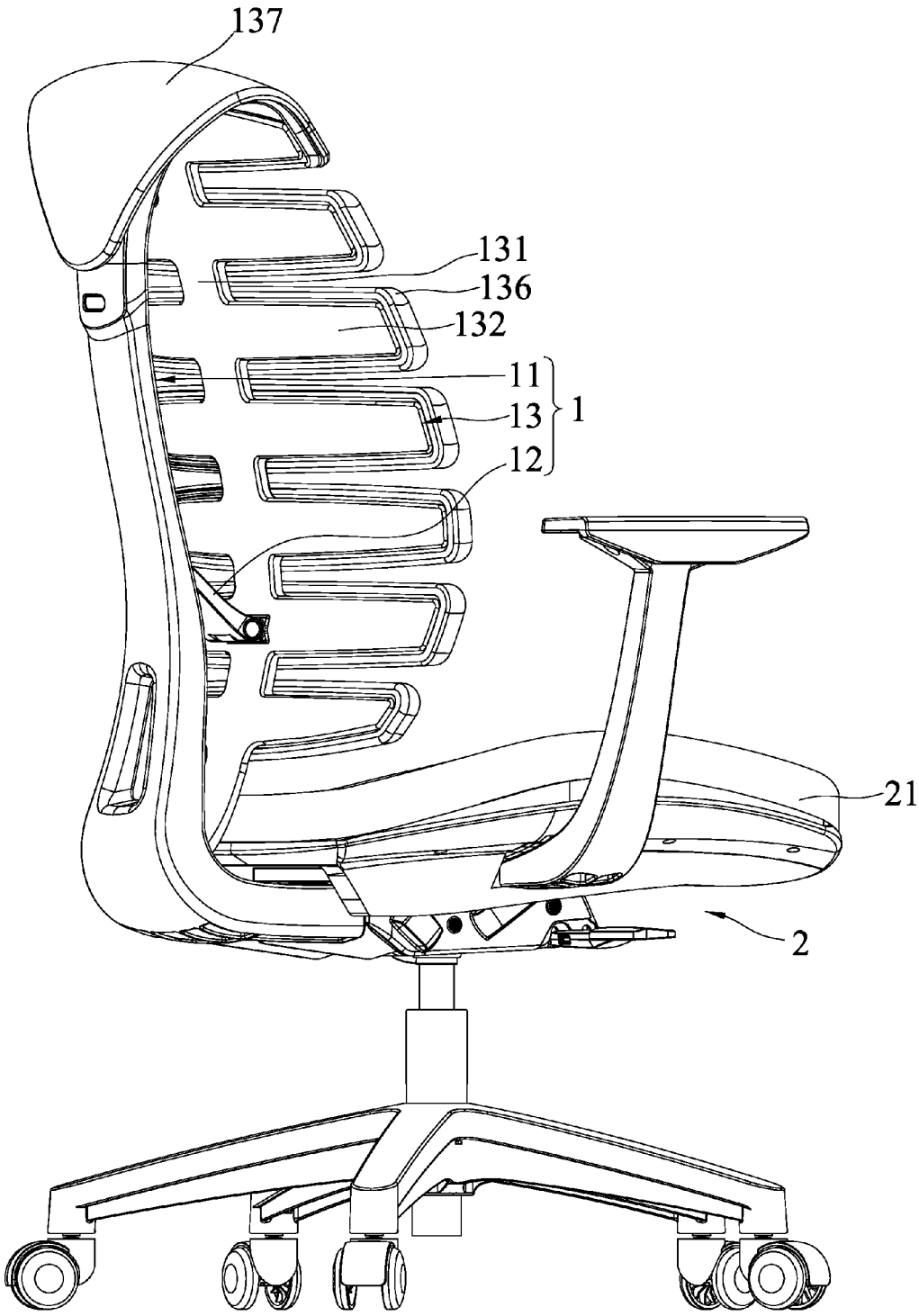
FIG. 7 is a pictorial rear view showing the invention connected to the chair seat.
Figure 8:
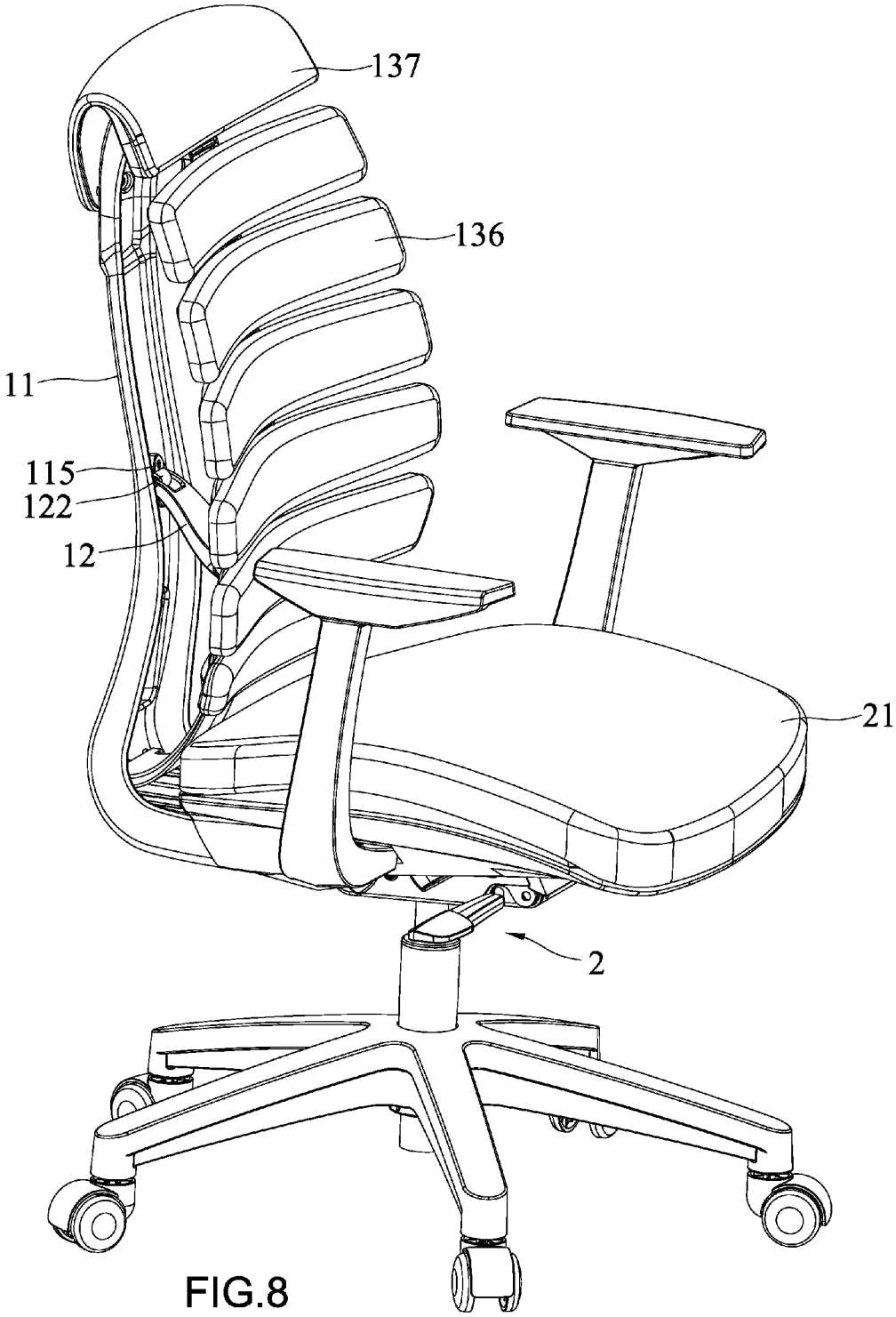
FIG. 8 is a pictorial front view showing the invention connected to the chair seat.

The backrest member 13 is composed of a vertical arch section 131 and several transversal curved sections 132 with different widths. The vertical arch section 131 and the transversal curved sections 132 are shaped into a herringbone-shaped structure, as shown in FIGS. 2 and 3. A third hinge portion 133 and a fourth hinge portion 134 are disposed on the top end and the middle segment of the vertical arch section 131 and disposed corresponding to the first hinge portion 113 of the main frame 11 and the second hinge portion 121 of the supporting member 12, respectively, as shown in FIGS. 2 and 4. In addition, a projection scarf joint 135 is disposed on the bottom end of the vertical arch section 131 corresponding to the connection projection 116 of the main frame 11, as shown in FIGS. 2 and 6. Each transversal curved section 132 of the backrest member 13 is covered with a seat backrest pad 136, as shown in FIGS. 1, 7 and 8. The seat backrest pad 136 is made of a foam material. The pivotal connection portion between the first hinge portion 113 of the main frame 11 and the third hinge portion 133 of the backrest member 13 is covered with a headrest pad body 137 in the form of an inverse-U shape. The headrest pad body 137 is made of a foam material. The vertical arch section 131 of the backrest member 13 has a resilient force for automatically recovering to the original shape after the deformation caused by the supported weight.

The practical assembling processes will be described in the following. First, the first hinge portion 113 of the main frame 11 is pivotally connected to the third hinge portion 133 of the backrest member 13, as shown in FIG. 4. Next, the second hinge portion 121 of the supporting member 12 is pivotally connected to the fourth hinge portion 134 of the backrest member 13, and the crossing portion 122 of the supporting member 12 is embedded into the embedded concave portion 114 of the resting seat 115, as shown in FIG. 5. Then, the projection scarf joint 135 of the bottom end of the vertical arch section 131 of the backrest member 13 is fitted with the connection projection 116 of the main frame 11, so that the backrest member 13 is firmly connected to the main frame 11, as shown in FIG. 6, and the supporting member 12 is disposed between and crosses over the backrest member 13 and the main frame 11. Finally, each seat backrest pad 136 is covered with the corresponding transversal curved section 132, and the headrest pad body 137 covers the pivotal connection portion between the first hinge portion 113 of the main frame 11 and the third hinge portion 133 of the backrest member 13, as shown in FIGS. 1, 7 and 8, and the seat back unit 1 of the invention is completed.

In practice, a rotatable supporting member 12 is slantingly disposed between the backrest member 13 and the main frame 11 of the invention seat back unit 1. The supporting member 12 has one end, which rests against and is connected to the resting seat 115 of the main frame 11 and is rotated relatively to the main frame 11. The supporting member 12 also has the other end, which is pivotally connected to the backrest member 13 and is rotatable relatively to the backrest member 13. Since the supporting member 12 prevents the supporting force of the backrest member 13 from concentrating at the same place, the backrest member 13 supports the back of the seated person to provide the comfortable flexibility and the stable security.

In summary, the seat back unit of the invention as filed has the novelty, inventive steps and industry utility.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A seat back unit to be connected to a seat of a chair, the seat back unit comprising a main frame, a supporting member and a backrest member;

wherein the main frame is a L-shaped member having a vertical section and a horizontal section, a top end of the vertical section has a first hinge portion, a resting seat having an embedded concave portion is fixed to a middle segment of the vertical section, and connection projections are disposed on a junction between the vertical section and the horizontal section;

the supporting member, which is a plate member having one end formed with a second hinge portion, and the other end formed with a crossing portion, which is embedded into the embedded concave portion of the resting seat; and the backrest member is composed of a vertical arch section and transversal curved sections, wherein the vertical arch section has a third hinge portion and a fourth hinge portion corresponding to the first hinge portion of the main frame and the second hinge portion of the supporting member, respectively.

2. The seat back unit according to claim 1, wherein the vertical arch section and the transversal curved sections of the backrest member are shaped into a herringbone-shaped structure.

* * * * *